US009640059B2

(12) United States Patent
Hyland

(10) Patent No.: US 9,640,059 B2
(45) Date of Patent: May 2, 2017

(54) SYSTEM AND METHOD FOR MONITORING HYGIENE STANDARDS COMPLIANCE

(75) Inventor: Kieran Richard Hyland, Blarney (IE)

(73) Assignee: HYINTEL LIMITED, Blackrock, County Cork (IE)

( * ) Notice: Subject to any disclaimer, the term of this patent is extended or adjusted under 35 U.S.C. 154(b) by 1123 days.

(21) Appl. No.: 12/223,841

(22) PCT Filed: Jun. 2, 2006

(86) PCT No.: PCT/EP2006/062895
§ 371 (c)(1),
(2), (4) Date: Apr. 12, 2010

(87) PCT Pub. No.: WO2007/090470
PCT Pub. Date: Aug. 16, 2007

(65) Prior Publication Data

US 2010/0188228 A1 Jul. 29, 2010

(30) Foreign Application Priority Data

Feb. 10, 2006 (IE) ..... S2006/0092

(51) Int. Cl.
*G08B 21/22* (2006.01)
*G08B 21/24* (2006.01)
*G08B 31/00* (2006.01)

(52) U.S. Cl.
CPC ..... *G08B 21/22* (2013.01); *G08B 21/245* (2013.01); *G08B 31/00* (2013.01)

(58) Field of Classification Search
CPC ..... G06K 7/0008; G06K 19/0723; G06K 19/07749; G06K 2017/0045; H04L 67/12; H04L 67/04; H01Q 1/2216
(Continued)

(56) References Cited

U.S. PATENT DOCUMENTS 3,997,873 A * 12/1976 Thornton ..... G03G 21/02 340/5.6
5,515,426 A * 5/1996 Yacenda ..... G08B 3/1083 250/338.1
(Continued)

FOREIGN PATENT DOCUMENTS

WO WO 01/33529 5/2001
WO WO 02/21475 3/2002
(Continued)

*Primary Examiner* — James Yang
(74) *Attorney, Agent, or Firm* — Valauskas Corder LLC

(57) ABSTRACT

This invention relates to a system and method of monitoring hygiene standards compliance in a medical facility in which there is provided a surveillance network having a monitoring unit 3 and a plurality of mobile network units 7. There may additionally be provided a plurality of fixed network units 5. The monitoring unit 3, mobile network units 7 and fixed network units 5 are connected by way of a Wireless Personal Area Network (WPAN), in this case a ZigBee network. Identification signals are sent from the mobiles network units 7 to the monitoring unit 3 and the monitoring unit stores the identification signals in memory and generates a hygiene standards compliance profile for an individual associated with a particular mobile network unit. The hygiene compliance profile may provide information relating to the number of times that a particular individual washed their hands to information regarding the patients that that individual came into contact with over the course of a shift. Reports on the behavior of individuals or groups of individuals may be generated.

34 Claims, 5 Drawing Sheets

(58) Field of Classification Search
USPC ..... 340/500, 540, 573.1, 1.1, 10.1–10.6, 340/572.1–572.9
See application file for complete search history.

(56) References Cited

U.S. PATENT DOCUMENTS

| | | | | |
|---|---|---|---|---|
| 5,765,242 | A * | 6/1998 | Marciano | E03C 1/057 4/623 |
| 6,539,393 | B1 * | 3/2003 | Kabala | G01S 5/0009 |
| 6,727,818 | B1 * | 4/2004 | Wildman | G06F 19/3418 340/10.1 |
| 7,319,397 | B2 * | 1/2008 | Chung | B60R 25/00 340/10.4 |
| 2011/0191124 | A1 * | 8/2011 | Sung | G01S 5/00 705/3 |

FOREIGN PATENT DOCUMENTS

| | | |
|---|---|---|
| WO | WO 2004/048994 | 6/2004 |
| WO | WO 2004/054304 | 6/2004 |
| WO | WO 2005/040984 | 5/2005 |

* cited by examiner

SYSTEM AND METHOD FOR MONITORING HYGIENE STANDARDS COMPLIANCE

This invention relates to a system and method for monitoring hygiene standards compliance by individuals in a medical facility.

Nowadays, one of the biggest problems faced by the health care service is the containment and prevention of spread of infectious diseases within the medical facility itself. Medical facilities such as hospitals, clinics, nursing homes and the like have been overrun in the last number of years with a number of multi-resistant highly infectious and virulent super bugs such as Methicillin Resistant Staphylococcus Aureus, commonly referred to as MRSA. These diseases, and MRSA in particular, pose one of the most significant threats to the provision of safe and effective health care treatment to patients. In many countries throughout the world. An alarming number of patients have contracted these diseases when in the medical facility itself when typically their immune system is already in a weakened state and this poses a number of difficulties for the health care service.

At present, in Ireland alone, MRSA and similar infections are estimated on average to increase the required stay of a patient in hospital by twelve days. Therefore, patients that may have been admitted to hospital for a relatively minor procedure that would normally require a stay in hospital of no more than a few days, and that contract MRSA are having to stay in hospital for significantly longer periods of time in doing so, that patient's bed is occupied and may not be used for another patient and this in turn puts a strain on a health service that is already under pressure to reduce waiting lists. Secondly, this increases the costs of treatment significantly as medical staff must attend to the patients afflicted with MRSA and a procedure that may have typically cost a couple of thousand euro to perform is turning into a significantly more expensive proposition for the health service as they must provide extended care to the patient.

Another problem with the spread of the MRSA bug in particular is that the Health Service is exposed to a massive liability and initial indicators are that the cost of litigation and compensation for the health service in settling the cases of patients that have contracted MRSA and other super bugs in the medical facilities run by the health service are likely to run into the hundreds of millions of Euro. Currently, there is no effective way for the health service to determine whether one of their staff members or a visitor that came in contact with the bug were responsible for the spread of the disease and therefore there is a significant difficulty for the health service to ascertain liability for a specific case of infection. In addition to this, the health service has no effective way of determining those members of staff that are adhering to best hygiene practice and those that are not and accordingly it is extremely difficult for the health service to ascertain those individuals responsible for the spread of the disease and provide an effective program of management and training to prevent further spread of the disease.

Taking the specific example of the MRSA bug, it is widely known that the spread of the MRSA bug in hospitals and similar facilities is predominantly through direct contact between patients and their carers. The MRSA bug may be transmitted from one patient to the next by a hospital employee that touches the body, bedclothes or other items that an infected patient has came into contact with and then touches another patient or items that the other patient will come into contact with out taking necessary precautionary measures. For example, it is envisaged that nurses changing bed linen or doctors or consultants doing their rounds may infect patients with MRSA through normal hand contact or through contact of their equipment such as stethoscopes with numerous patients. It is widely acknowledged that better cleanliness of the carers and sterilisation of their equipment will significantly reduce the incidences of infection in the medical facilities. It is further acknowledged, that improved adherence to hand washing by the carers between contacts with different patients will lead to a significant reduction in the number of infected cases each year. It has been estimated and various trials have shown that by carers adhering strictly to a hand washing regime with disinfectant between incidences of contact with patients, the number of infections of MRSA caused by the carers would reduce by 35%. This would have significant benefits to the medical profession, the health service as a whole and the patients themselves.

Various pilot projects have been devised in hospitals in particular to encourage greater awareness of the dangers of MRSA and the simple preventative measures that may be taken to prevent its spread. These have largely revolved around educational campaigns and information leaflets being distributed throughout hospitals to both staff and visitors alike. Furthermore, various initiatives have been put in place to ensure better hand washing practices are adhered to in hospitals. There are however, numerous problems with the existing initiatives. Although a step in the right direction, there is no way at present for the health service to monitor the adherence of individuals and departments to these best practices. Therefore, the efforts of many may be greatly hindered by the non-adherence by a few in a department. It is only by closely monitoring the adherence of all staff members can they begin to combat the spread of the disease. Furthermore, there is currently no way for the health service to determine if a patient becomes infected, whether they were infected by the carers or by a relative as they have no way of comprehensively monitoring the carers that have come into contact with a patient and more specifically they have no way of monitoring whether those carers that did come into contact with an infected patient took all due care and reasonable measures to avoid infecting the patient. If they had, then it would be easier to determine exactly where and how the patient was likely to have contracted the disease and how further spread may be prevented.

It is an object therefore of the present invention to provide a system and method for monitoring hygiene standards compliance that is both relatively simple and cost efficient to install and that allows for comprehensive monitoring of the hygiene standards compliance of staff members in a non-obtrusive, effective manner that overcomes at least some of the problems associated with the known systems and methods.

STATEMENTS OF INVENTION

According to the invention there is provided a hygiene monitoring system for monitoring hygiene standards compliance by individuals in a facility, the system comprising a surveillance network having a monitoring unit and a plurality of mobile network units, each of the mobile network units having a transmitter for transmitting an identification signal particular to an individual associated with that mobile network unit to the monitoring unit, the monitoring unit further comprising a processor, an accessible memory and a receiver for receiving the identification signals from the mobile network units, the monitoring unit storing the identification signals in accessible memory and the processor having means to analyse the identification signals in accessible memory and generate a hygiene standards compliance profile for the individual associated with that mobile network unit.

By having such a system, in a medical facility in particular, it is possible for the health service to monitor the work practices and/or the movement of individual carers or other users that are carrying a mobile network unit in the medical facility. Ideally, the health service will be able to use the identification signal to track the movement of the individuals throughout the course of a day by determining the location of the mobile network unit each time an identification signal is transmitted and thereafter they may be able to determine whether a worker was in contact with one or more specific patients at a particular time or throughout the course of the day. Furthermore, by tracking the position of the mobile network unit, it is possible to tell if the mobile network unit and hence the worker has been at a sink unit that would typically indicate that they washed their hands. This enables the system to build a hygiene compliance profile for the individual associated with the mobile network unit. Essentially therefore, the system provides an assurance system for the hospital whereby they are able to carefully monitor the contacts between staff and others using the system and determine whether the infection was caused by them or not. The existence of such a system based on the invention will itself lead to an increase in hand washing with a resultant decrease in infection.

In one embodiment of the invention there is provided a system in which the mobile network units have means to periodically generate an identification signal for transmission. By periodically generating an identification signal, for example every thirty seconds, a continuous stream of identification signals will be sent from the mobile network unit to the monitoring unit and this will allow for tracking of the mobile network unit in the medical facility over time.

In another embodiment of the invention, there is provided a system in which the mobile network units have means to generate an identification signal for transmission in response to the actions of the individual associated with that mobile network unit. In this way, the system allows for the mobile network unit to transmit an identification signal in response to a user's actions such as operating a soap dispenser or a hand operated portable hygiene device. Therefore, the system can monitor if and when a worker performs a particular act such as cleaning their hands in a sink or cleaning their hands with cleaning fluid between patients. Furthermore, the system will allow the monitoring unit to identify those employees or departments that are operating in a responsible manner avoiding spread of disease and those individuals or departments that are not adhering to compliance to a hand washing or other regime. This further enables the system to provide an assurance system for the hospital whereby they are able to carefully monitor the contacts between individuals and others using the system and determine whether the infection was caused by them or not.

In a further embodiment of the invention there is provided a system in which the mobile network units are formed as part of an antibacterial fluid dispenser. Preferably, the antibacterial fluid dispenser further comprises a sensor to detect actuation of the antibacterial fluid dispenser, and the means to generate an identification signal for transmission in response to the actions of the individual associated with that mobile network unit comprises means to generate the identification signal on the sensor detecting the antibacterial fluid dispenser being actuated. By generating an identification signal each time the fluid dispenser is used, the system will record the number of times that a particular individual, such as a doctor, nurse, or other health care worker associated with the mobile network unit washed their hands using the antibacterial dispenser throughout the course of their shift. This information may be invaluable when building a hygiene standards compliance profile for the individual. In this particularly preferred embodiment of the invention, each employee may be provided with a portable antibacterial fluid dispenser that may clip on to their belt for example and they may use that dispenser to dispense a small amount of antibacterial fluid onto their hands whenever necessary, according to protocol, which may be set by the hospital or healthcare facility authorities. In this way, the staff members will clean, according to protocol, their hands each time they have contact with a different patient and therefore significantly reduce the chance of passing on the MRSA bug to the other patients. Furthermore, by having the mobile network unit transmitting the identification signal each time the dispenser is operated, it is possible to record the number of times a particular employee or person obliged to use the system washed their hands and where they were when they washed their hands which further facilitates monitoring of the employees hygiene standards compliance.

In another embodiment of the invention there is provided a system in which the surveillance network further comprises a plurality of fixed network units dispersed throughout the medical facility, each of the fixed network units having a transceiver to receive identification signals from the mobile network units and transmit the identification signals onward to the monitoring unit. This is seen as a particularly useful implementation of the system according to the invention that will essentially allow for lower powered devices and less complex devices to be used for the mobile network units as their identification signals may be relayed through the fixed network units to the monitoring unit. Furthermore, by arranging the system in this manner it is possible to guarantee monitoring coverage throughout the desired areas without worry of interference or difficulty in transmitting a signal from a particular area in the medical facility.

In a further embodiment of the invention there is provided a system in which each of the fixed network units further comprises means to determine the strength of the identification signals received, for onward transmission of the signal strength data to the monitoring unit along with the relevant identification signal. Ideally, the processor has means to determine the position of the mobile network unit from the identification signal strength data received from one or more fixed network units. By incorporating the strength signal data, it is possible to more accurately determine the exact position of an employee at the moment that the identification signal is transmitted. The strength of the signal alone will allow the monitoring unit to indicate the whereabouts of a mobile network unit relative the fixed network devices. The monitoring unit may receive signal strength data from two or more separate fixed network units and this will allow the processor to determine the position of the mobile network unit at the time of transmission of the identification signal by triangulating the signal. The approximate position of the mobile network unit may be determined by using the information from three separate fixed network units.

In another embodiment of the invention there is provided a system in which the fixed network units have means to receive an identification signal from a mobile network unit within a predetermined radius of the fixed network unit. It is envisaged that the predetermined radius of the fixed network unit may be set at a 5 meter radius. In this way, the fixed network units may be arranged in a cluster to ensure that the signal from a mobile network unit will be picked up from one or more fixed network units and secondly, a stronger signal may be achieved and greater positioning accuracy may be achieved.

In one embodiment of the invention there is provided a system in which the mobile network units and the fixed network units form part of a wireless personal area network (WPAN). By using the wireless network, the system is simple to install in practically any installation and furthermore is scalable and adaptable to the introduction of new employees and or the introduction of additional areas to be monitored. Preferably, the WPAN is a ZigBee network. This is seen as a particularly useful wireless network to use that may be installed with the minimum of difficulty in a relatively unobtrusive manner. A ZigBee network is seen as particularly useful as the amount of information that must be communicated for each instance of the identification information being sent is relatively small compared with other systems. This is an advantage for data monitoring and reduces the computational as well as the communication overhead of the entire system. Secondly, the ZigBee network uses relatively little energy and it is possible to run a device without having to change the battery or carry out further maintenance for long periods. Thirdly, the ZigBee network is relatively cost efficient to install which may be particularly relevant in large installations and finally and most advantageously, the ZigBee network is seen as particularly useful in a medical environment.

In a further embodiment of the invention there is provided a system in which the monitoring unit has access to a floor plan layout of the medical facility and the monitoring unit has means to plot the location of the mobile network unit in the medical facility over time as part of the hygiene standards compliance profile for the individual associated with that mobile network unit. Preferably the identification signal data received by the monitoring unit is time stamped. In this way, the of the mobile network device may be plotted on the floor plan layout to show movement patterns and compare these movement patterns with the hygiene standards compliance patterns. In this way, areas at particular risk may be identified and furthermore, more precise positioning of the mobile network units and accordingly the employees carrying the mobile network units may be achieved. The position of an employee at a particular point in time that they washed their hands or not as the case may be may be determined in a more detailed manner which will allow for greater plotting of the exact behaviour of the employee. Furthermore, the work practices of individuals or groups of employees may be determined as well as their specific methods and these can be evaluated and altered if necessary.

In one embodiment of the invention there is provided a system in which the mobile network unit further comprises means to receive an identity code from a user and the identification signal transmitted by the mobile network unit is generated using the identity code of the user. Preferably, the means to receive an identity code from a user further comprises a card reader having means to read information from a data storage element on an identity card provided by the user. Alternatively, the means to receive identity codes from a user further comprises a keypad having means to receive an identity code input by the user on the keypad. In this way, the mobile network units may be built into a disinfectant fluid dispenser or other device that may be issued to each employee as they begin their shift. The employee may enter their security access pass that may have a chip or other memory device such as a magnetic strip associated therewith into an appropriate card reader in the mobile network unit and the mobile network unit reads their security card and sends a signal particular to that employee over the wireless network to the monitoring unit. The security card and card reader are seen as very simple and cost effective devices to incorporate in the invention.

In one embodiment of the invention there is provided a system in which the processor has means to analyse the movement patterns of one of an individual mobile network unit or a group of mobile network units. Preferably, there is provided as system in which the monitoring unit has means to analyse the movement patterns of one or more mobile network units in a particular area of the medical facility. In this way, the health service may accurately measure the activity of lone employees or groups of employees and provide an analysis of the information retrieved to determine whether the employees are carrying out best practice or not. In this way, by analysing the movement patterns, it is easier to determine how an infection was spread or the typical work patterns of particular individuals in an area that will assist in determining areas at the greatest risk. This facilitates risk management in the entire facility. Furthermore, by having such a system, the movement of the individuals in an entire department or ward may be monitored simultaneously and reports on individual staff or entire wards being generated to allow a thorough analysis to be achieved. In this way, it is possible to draw comparisons between practices in different wards in a hospital or even to draw comparisons between the practices of certain hospitals versus other hospitals. This may allow decision on funding and the like to be made dependent on certain hospitals adherence to best work practices as well as to dictate work and pay agreements of staff in particular hospitals or hospital wards.

Ideally, there is provided a system in which the monitoring unit has means to generate an alarm based on predetermined irregular usage patterns of one or more mobile network units.

In one embodiment of the invention there is provided a system in which the monitoring unit has means to compare the activity of a mobile network unit in the medical facility with a predetermined set of mobile network unit parameters and generate an alarm if the activity of the mobile network unit is outside the predetermined set of mobile network unit parameters. In this way, if an employee is not washing their hands between patients or if they are deemed to be putting patients at risk due to their current work practices, this may be identified in a relatively simple, and automatic manner and brought to the attention of an operator, who may be an infection controller, who can determine what further course of action, if any, is to be taken. For example, it may be determined that the average number of times that a nurse has direct contact with patients during a shift may be fifty times, in which case the best practice may be for the nurse to wash their hands either using a portable unit or other fixed sink unit fifty times per shift in highly infected areas. If it is found that a nurse operating in those areas is only washing his or her hinds twenty times a day or less, further investigation into the work practices of that individual may be carried out.

In another embodiment, of the invention there is provided a system in which the monitoring unit has means to generate a report based on the hygiene standards compliance profile of one or more mobile network units over a given period of time. Ideally, the monitoring unit has means to transmit the report to a remote station for further analysis of the report. In this way, analysis of the report may be made by the supervisors in a particular ward. For example, at the end of each shift, the supervisors may be sent data relating to the hygiene standards compliance within their particular area of control and may act accordingly by rewarding those who are operating well within the required parameters and bringing shortcomings to the attention of others whose practices are insufficient. Furthermore, the management of a hospital may also monitor the compliance on a group by group basis and they may determine that a particular ward is proving to be a liability and that the staff in that ward require more training or disciplinary warnings if need be for repeated offenders.

In one embodiment of the invention there is provided a system in which there are provided a plurality of identification network units, each of which is associated with a patient in a medical facility, the identification network units having a transmitter to transmit a patient identifier signal to the monitoring unit and the monitoring unit having means to plot the position of the patient in the medical facility over time. By having such a system, it is possible to more accurately determine whether a particular patient moved from their bed at a certain time and therefore possibly were not in the location that they are normally assumed to be i.e. their bed in a particular ward. Furthermore, patients going for X-Rays, scans or other procedures in other parts of the hospital are monitored and the contacts of individuals in the X-ray department, for example, with them is also carefully monitored if desired. This may be important to determine exactly the profile for a patient that may have contracted disease in a particular medical facility and the health service may monitor the whereabouts of the patient at all times during their stay and build a profile for that patient to carefully determine the personnel that they came into contact with. The identification network unit may be provided in a wrist band type device or other simple device that may be carried by the patient at all times throughout their stay.

In another embodiment of the invention, there is provided a method of monitoring hygiene standards compliance by individuals in a medical facility, the medical facility having a surveillance network comprising a monitoring unit and a plurality of mobile network units, each of the mobile network units having a transmitter for transmitting an identification signal particular to an individual associated with the mobile network unit to the monitoring unit, the monitoring unit having a processor, an accessible memory and a receiver for receiving identification signals, the method comprising the steps of

- the mobile network units transmitting identification signals particular to the individual associated with the mobile network unit to the monitoring unit;
- the monitoring unit storing the identification signals in accessible memory; and
- the monitoring unit analysing the identification signals stored in accessible memory and thereafter generating a hygiene standards compliance profile for one or more of the individuals associated with the mobile network units.

In a further embodiment of the invention there is provided a method in which the mobile network units periodically transmit an identification signal to the monitoring unit.

In one embodiment of the invention there is provided a method in which the mobile network units transmit an identification signal to the monitoring unit in response to the actions of the individual associated with that mobile network unit.

In another embodiment of the invention there is provided a method in which the mobile network unit forms part of an antibacterial fluid dispenser and the mobile network unit transmits the identification signal to the monitoring unit on actuation of the antibacterial fluid dispenser.

In a further embodiment of the invention there is provided a method in which the mobile network unit transmits the identification signal to the monitoring unit on the mobile network unit coming within a predetermined distance of a hand washing facility.

In one embodiment of the invention there is provided a method in which the mobile network units transmit position data to the monitoring unit along with the identification signal giving the position of the mobile network unit in the medical facility.

In another embodiment of the invention there is provided a method in which the surveillance system further comprises a plurality of fixed network units, the identification signals being transmitted from the mobile network units to the monitoring units through one or more fixed network units.

In a further embodiment of the invention there is provided a method in which two or more fixed network units receive the identification signal directly from the mobile network unit, each of the fixed network units determine the signal strength of the received identification signal and transmit the signal strength data to the monitoring unit along with the identification signal, the monitoring unit determining the position of the mobile network unit in the medical facility from the received signal strength data.

In one embodiment of the invention there is provided a method in which the step of generating a hygiene standards compliance profile further comprises the monitoring unit plotting the location of the mobile network unit in the medical facility over time.

In another embodiment of the invention there is provided a method in which the step of generating a hygiene standards compliance profile for each of the mobile network unit users further comprises determining the number of times that the mobile network unit user washes their hands in a particular time period.

In a further embodiment of the invention there is provided a method in which the method further comprises the step of combining the hygiene standards compliance profile of a plurality of mobile network unit users and generating hygiene standards compliance profiles for a group of users.

In one embodiment of the invention there is provided a method in which the method further comprises the steps of the monitoring unit comparing the activity of one or more mobile network unit users with a predetermined set of mobile network unit parameters and generating an alarm if the activity of the mobile network unit user is outside the predetermined set of mobile network unit parameters.

In another embodiment of the invention there is provided a method in which the initial step is carried out of the network unit receiving an identity code provided by the user and the mobile network unit generating the identification signal based on the identity code provided by the user.

In a further embodiment of the invention there is provided a method in which the processor analyses the activity patterns of one or more mobile network units.

In one embodiment of the invention there is provided a method in which the processor analyses the activity patterns of one or more mobile network units in a particular area.

In another embodiment of the invention there is provided a method in which the processor generates an alarm on detecting irregular activity patterns of one or more mobile network units.

In a further embodiment of the invention there is provided an antibacterial fluid dispenser comprising a fluid reservoir for antibacterial fluid, a charging inlet and a discharge outlet, a dispensing mechanism co-operating with the discharge outlet for dispensing a predetermined amount of antibacterial fluid from the fluid reservoir on actuation by a user, characterised in that the antibacterial fluid dispenser is further provided with a transmitter for transmission of an identification signal particular to an individual associated with the antibacterial fluid dispenser to a remote monitoring unit.

In one embodiment of the invention there is provided an antibacterial fluid dispenser in which the dispenser is provided with means to periodically generate an identification signal for transmission to the remote monitoring unit.

In another embodiment of the invention there is provided an antibacterial fluid dispenser in which the dispenser is provided with a sensor to detect actuation of the dispensing mechanism and means to generate an identification signal for, transmission to the remote monitoring unit on detecting actuation of the dispensing mechanism.

In a further embodiment of the invention there is provided an antibacterial fluid dispenser in which the dispenser is provided with a proximity sensor to detect the presence of a hand washing facility within a predetermined distance from the dispenser and means to generate an identification signal for transmission to the remote monitoring unit on detection of the hand washing facility.

In one embodiment of the invention there is provided an antibacterial fluid dispenser in which the dispenser has means to modify the identification signal to indicate the cause of the generation of the identification signal.

In another embodiment of the invention there is provided an antibacterial fluid dispenser in which the dispenser has means to receive an identity code from the individual associated with the dispenser and thereafter generate an identification signal particular to the individual using that identity code.

In a further embodiment of the invention there is provided an antibacterial fluid dispenser in which the means to receive an identity code from the individual associated with the dispenser further comprises a card reader having means to read information from a data storage element on an identity card provided by the user.

In one embodiment of the invention there is provided an antibacterial fluid dispenser in which the means to receive an identity code from the individual associated with the dispenser further comprises a keypad having means to receive an identity code input by the user on the keypad.

DETAILED DESCRIPTION OF THE INVENTION

The present invention and its attributes and advantages will be further understood and appreciated with reference to the detailed description below of presently contemplated embodiments, taken in conjunction with the accompanying drawings.

The invention will now be more clearly understood from the following description of some embodiments thereof given by way of example only with reference to and as illustrated in the accompanying drawings in which: —

Figure 1:
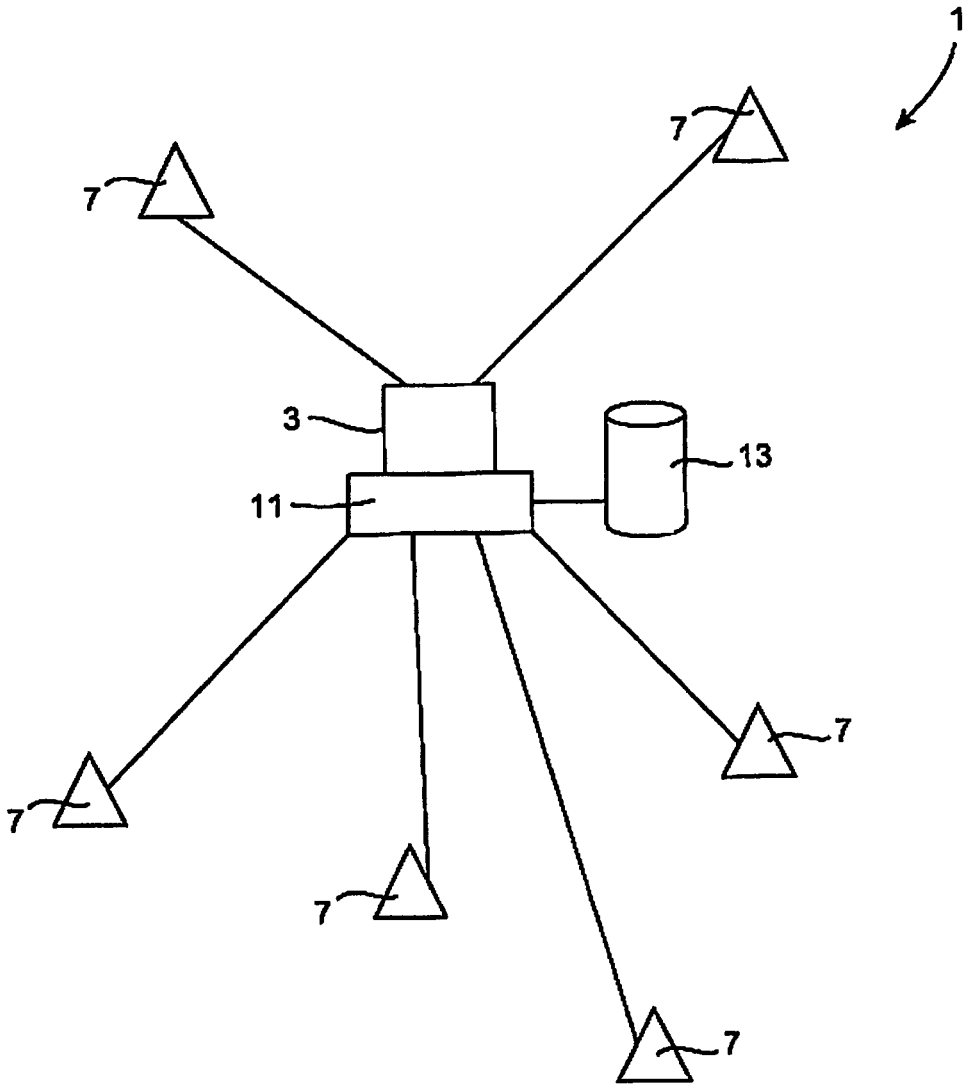
FIG. 1 is a diagrammatic representation of the system according to the present invention.

Referring to the drawings and initially to FIG. 1 thereof there is shown a diagrammatic representation of the system according to the present invention, indicated generally by the reference numeral 1, comprising a monitoring unit 3 and a plurality of mobile network units 7. The monitoring unit 3 further comprises a processor 11, an accessible memory 13 and a receiver (not shown). Each of the mobile network units 7 comprises a transmitter (not shown) for transmitting an identification signal from the mobile network unit 7 to the monitoring unit 3.

In use, each of the mobile network units 7 transmits an identification signal from the mobile network unit to the monitoring unit 3. This identification signal may be a signal periodically transmitted by the mobile network unit with the co-ordinates of the mobile network unit in the medical facility at that point in time or alternatively this identification signal may be a signal indicating that the individual associated with the mobile network unit has carried out a hand washing procedure by actuating a sink unit (not shown), an antibacterial fluid dispenser (not shown) or other such device. In addition to the signal indicating that a hand washing procedure has been carried out, the signal may also give the co-ordinates of the mobile network unit in the medical facility at the time of the hand washing incident occurring. This will allow for a hygiene standards compliance profile to be generated for the individual. The hygiene standards compliance profile may simply be that a particular individual has washed their hands a certain number of times in a predetermined time period or that they have washed their hands every time that they entered a particulars room or came into contact with a particular patient. The information conveyed will largely depend on the complexity of the identification signal transmitted and furthermore will depend on the capability of the mobile network unit itself e.g. GPS capability.

Figure 2:
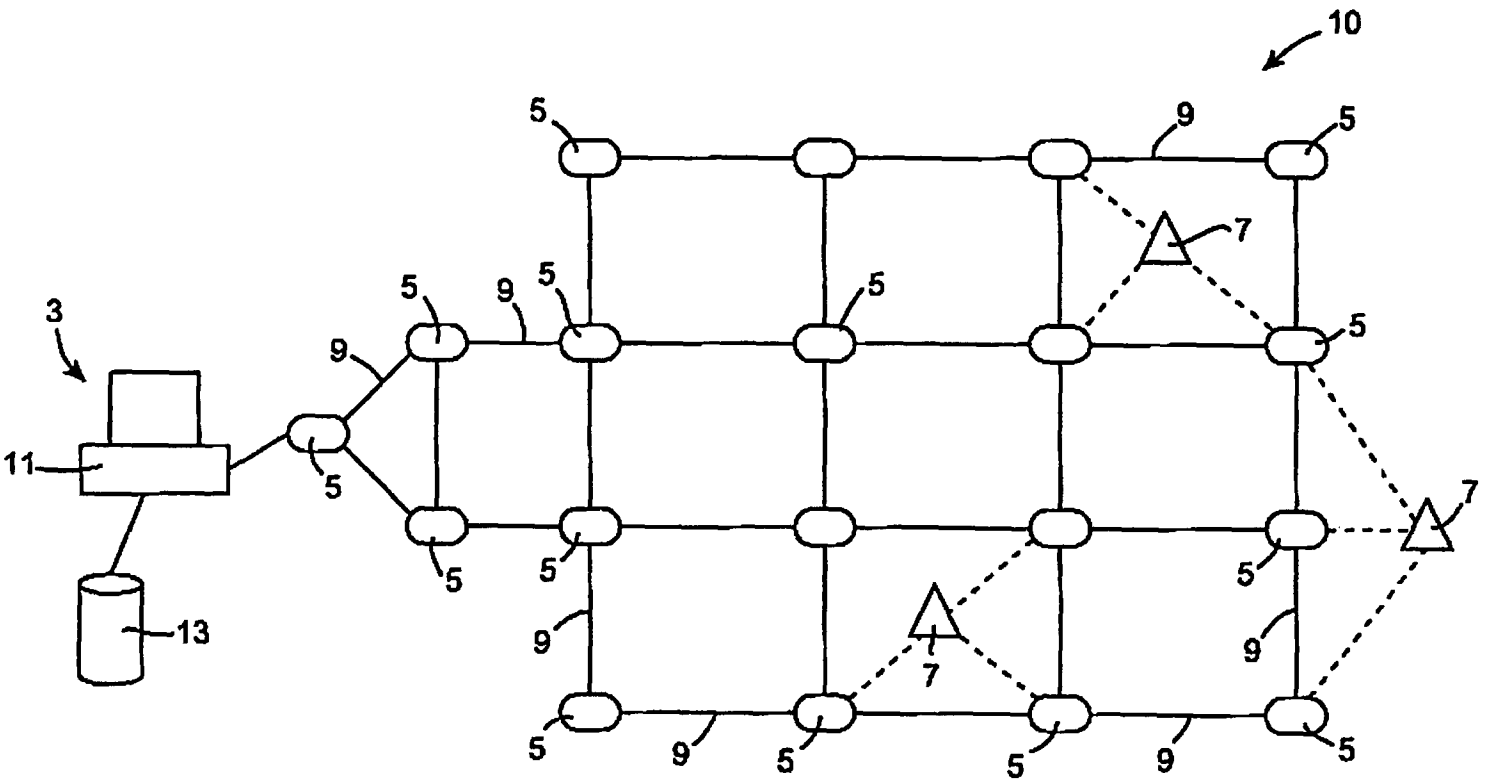
FIG. 2 is a diagrammatic representation of an alternative embodiment of the system according to the present invention.

Referring to FIG. 2 of the drawings there is shown an alternative embodiment of the system according to the invention in which like parts have been given the same reference numerals as before, indicated generally by the reference numeral 10, comprising a monitoring unit 3, a plurality of fixed network units 5 and a plurality of mobile network units 7. The monitoring unit 3, the plurality of fixed network units 5 and the plurality of mobile network units 7 are connected by way of a wireless communication network, whose links 9 provide a communications channel from the mobile network units 7 to the monitoring unit 3 via the fixed network units 5. The monitoring unit 3 further comprises a processor 11 and accessible memory 13. Each of the mobile network units comprises a transmitter (not shown) for transmitting an identification signal from the mobile network unit and each of the fixed units comprises a transceiver (not shown) for receiving the identification signals and transmitting the identification signals over the communication links 9 to the monitoring unit.

In use, a staff member carries a mobile network unit on their person. This mobile network unit may or may not be formed as part of another device such as an antibacterial fluid dispenser. The mobile network unit 7 periodically transmits an identification signal to the surrounding environment. This identification signal is picked up by any fixed network unit 5 within a predetermined radius, in this case 5 meters, of the mobile network unit. On receipt of the identification signal, the fixed network units that received the identification signal transmit that signal from the fixed network unit to the monitoring unit 3 where the processor 11 determines the identity of the transmitting mobile communication unit and thereafter logs the information in memory 13 for subsequent analysis. The information sent by the fixed network units further comprises signal strength data and when the processor receives the signal strength data along with the identification date, the processor may determine the location of the mobile network unit. Therefore, the position of the mobile network unit at that moment in time may be determined. In addition to periodically transmitting the identification signal, the mobile monitoring unit also transmits data in response to the actions of the user carrying the mobile network unit. For example, if the mobile network unit forms part of an antibacterial fluid dispenser used for washing the member of staffs hands, the mobile network unit may be arranged to transmit a definitive identification signal on the actuation of the dispensing mechanism indicating that the employee has washed their hands with antibacterial fluid in accordance with best practice in the control of infectious diseases in a hospital environment. This act will be logged as a hand washing incident in the monitoring unit memory 13 along with the identification signal data indicating the particular employee and their location at that time. Similarly, the users action that causes the transmission of an identification signal may be the user moving within a certain distance of a sink unit in a ward or by operating the sink unit and these will cause the identification signal to be transmitted. When actuated or when moving within a certain distance of the sink unit, the sink unit sends out an identification request which is received by an employee's mobile network unit which responds with its identifier signal. In this instance, the mobile network unit will also be provided by a suitable transceiver or a receiver to receive such signals from the fixed network unit.

The identification signal transmitted by the mobile network unit is transmitted and received by a plurality of fixed network units, in the embodiment shown, three fixed network units 5 receive the identification signal, indicated in broken lines in FIG. 1. In this way, the position of the mobile network unit 7 may be quickly calculated/triangulated on the monitoring unit processor 11 in a simple and efficient manner with the minimum of difficulty. All of the data is then logged by the monitoring unit which may subsequently generate reports based on the mobile network unit's position and usage patterns gleaned from the identification data and accordingly the staff hygiene practices may be carefully monitored.

Figure 3:
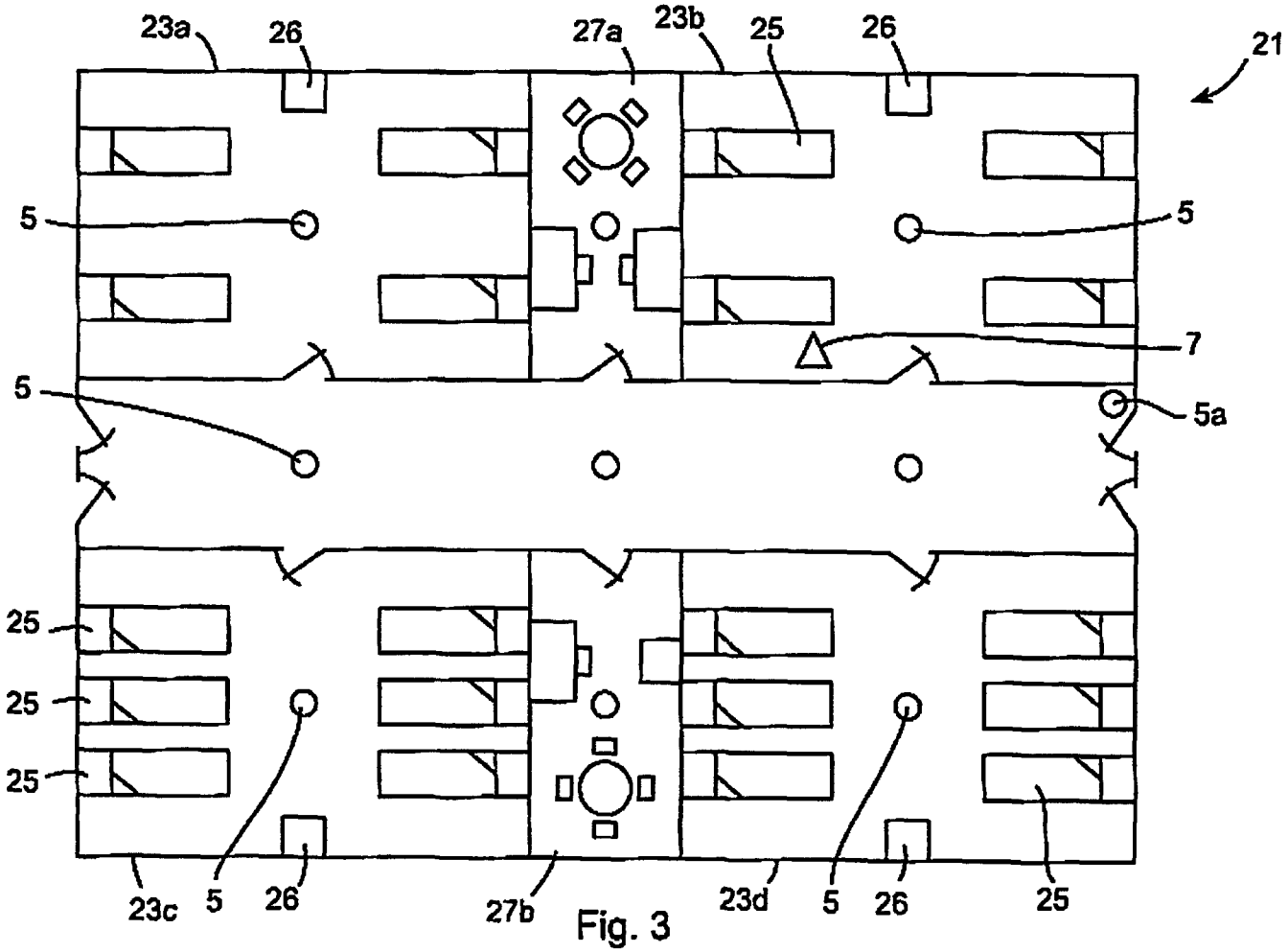
FIG. 3 is a diagrammatic representation of a floor plan of a hospital ward in which the system shown in FIG. 2 is installed.

Referring to FIG. 3 of the drawings there is shown a diagrammatic representation of a floor plan of a hospital ward in which the system according to the present invention may be installed. The ward, indicated generally by the reference numeral 21, comprises a plurality of separate rooms 23*a*, 23*b*, 23*c* and 23*d* for patients, each room 23*a*, 23*b*, 23*c*, and 23*d* having a plurality of beds 25 for patients and a sink unit 26 therein. There are further provided additional rooms pa end 27*b* which may be used by the medical staff for other purposes such as a nurse's station, pharmacy or rest area. A plurality of fixed network units 5 are located in the ward each having means to receive an identification signal from a mobile network unit 7 carried by a staff member (not shown). At least one of the fixed network units 5*a* is positioned so that it may communicate with other fixed network units (not shown) outside of that particular ward in order to establish a communications channel with the monitoring unit or so that it may communicate with the monitoring unit (not shown) directly.

In use, a staff member such as a consultant may move from room to room visiting different patients of theirs in beds in each of the rooms 23*a*, 23*b*, 23*c* and 23*d*. As the consultant moves from room to room in the ward 21, their mobile network device 7 is all the time periodically transmitting identification signals which are picked up by the fixed network units 5 throughout the ward 21 and the identification signals are relayed to the monitoring unit (not shown) detailing the position of the consultant at that given time. Furthermore, if the consultant comes within a predetermined range of a sink unit 26, an identification signal will be sent indicating that the consultant has washed their hands at the sink unit 26. Furthermore, if the mobile network unit 7 is part of an antibacterial fluid dispenser (not shown), each time the consultant operates the dispensing mechanism of the dispenser to dispense some antibacterial fluid to wash their hands, the mobile network unit will transmit an identification signal to indicate that they have washed their hands in a particular location at a particular time. All of this information is logged in the memory of the monitoring unit for subsequent analysis. Instead of the consultant coming into the vicinity of the sink unit 26, the consultant may in fact have to operate the sink unit in order for an identification signal to be sent.

Ideally, there may be a small difference between the identification signal transmitted by the mobile network unit on actuation of the dispenser and the identification signal that is periodically transmitted by the mobile network unit to clearly distinguish between the two signals and record the dispensing action as such. Similarly, the identification signal transmitted on the mobile network unit coming into proximity with or actuating a sink unit may be the same as the identification signal sent on the dispenser being actuated to identify simply a hand washing incident or may be marginally different to the signal to record this as a separate event in its own right for recordal purposes.

In doing their rounds and going around the various rooms 23*a*, 23*b*, 23*c* and 23*d* in the ward, the consultant may knowingly or unknowingly came in to contact with an individual infected with the MRSA bug in room 23*a*, for example. The consultant's presence in the room will have been logged and if they spend a certain period of time at the bedside of an individual, their presence in that location will have been logged. The hospital will also be able to determine what patient is staying in that bed and whether or not they are an infection risk if the consultant then washes their hands using a portable antibacterial fluid dispenser incorporating the mobile network unit, this act will be transmitted as part of an identification signal and this in turn will be logged in memory also. Alternatively, if the consultant goes to a sink unit 26 in a room and washes his or her hands, this will be logged automatically. Similarly, if the consultant moves from room to room, the system can identify when the consultant has washed their hands and whether or not the consultant posed a risk to any patient through lax hygiene procedures. By fogging the information in this way, the information may be reviewed and constant offenders may be singled out for a warning or alternatively, groups or wards that fall below acceptable standards may be alerted to the fact to allow them improve their practice.

It is envisaged that the patients (not shown) may also be provided with an identification network unit (not shown) so that there whereabouts may also be tracked throughout their stay in the hospital. This may assist in providing an exact location for the patients at a given time and enable for a greater degree of certainty that the patient was in a particular location where they made contact with a particular individual such as a consultant doing their rounds. The identification network units would not therefore have any requirement to register hand washing incidents but rather could simply be used to emit a location identifier periodically so that there whereabouts may be detected. The identification network unit may itself be formed as part of a wristband or similar device already commonly worn by patients to minimise the inconvenience and difficulty in implementing the new procedures.

Figure 4:
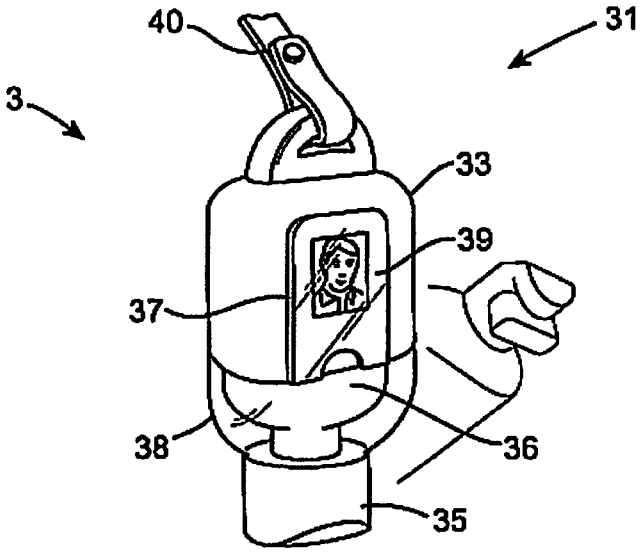
FIG. 4 is a perspective view of one embodiment of a portable antibacterial fluid dispenser incorporating a mobile network unit.

Referring to FIG. 4 of the drawings there is shown a portable antibacterial fluid dispenser 31 incorporating a mobile network unit 3. The antibacterial fluid dispenser 31 comprises a fluid reservoir 33 containing the antibacterial fluid, having a discharge outlet (not shown) and a dispensing mechanism 35 for dispensing a predetermined amount of fluid from the fluid reservoir 33 through the discharge outlet. Preferably, the discharging mechanism is a spray nozzle such as those typically found on perfume bottles and the like that provides a relatively dispersed and fine mist of fluid from the reservoir but this is not essential and is largely dependent on the consistency of the antibacterial fluid. The antibacterial fluid dispenser further comprises a card reader 37 for receiving a security identity card 39 of a staff member and reading unique identifier data relating to that staff member from a memory chip (not shown) on the security identity card. The card reader 37 co-operates with the transmitter (not shown) of the mobile network unit to allow the mobile network unit transmit an identification signal particular to the owner of the security identity card in the embodiment shown, the portable antibacterial fluid dispenser essentially comprises a casing with a suitable dispensing mechanism that receives a refill cartridge 36 of antibacterial fluid in the reservoir and at least portion 38 of the portable antibacterial fluid dispenser 31 reservoir is in fact transparent to allow the user to see the quantity of fluid left in the refill cartridge. The portable antibacterial fluid dispenser is provided with means 40 to attach the dispenser to a belt of a staff member's clothing.

Figure 5:
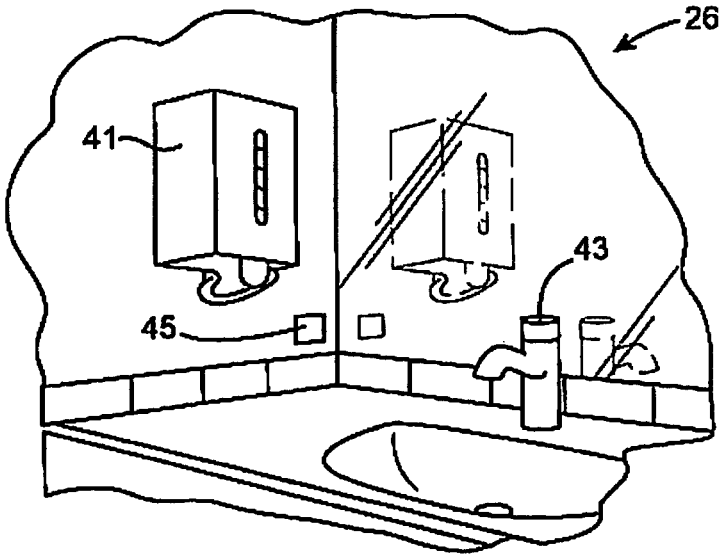
FIG. 5 is a perspective view of a hand basin unit incorporating a fixed network unit.

Referring to FIG. 5 of the drawings there is shown a sink unit that may form part of the present invention. The sink unit 26 further comprises a soap dispenser 41 with antibacterial fluid contained therein, a water supply 43 and a sensor 45 to determine when the soap dispenser is in use. The sensor may or may not be an integral part of the soap dispenser. The sensor shown is an infra red cell that determines when an individual is using the soap dispenser. Alternatively, any one of a number of sensors could be used as would be understood by the person skilled in the art. When the sensor detects that the soap dispenser is being used, a check is made to see if there is a mobile network unit in the vicinity of the sink unit 26 and if so it is determined that the mobile network device holder is using the soap dispenser 41 and they are logged as having washed their hands. Alternatively, if no mobile network device is detected it is assumed that a visitor is using the soap dispenser and this may be logged elsewhere or discarded. It is envisaged that the sensor 45 may in fact be a fixed network unit 5 and if the signal strength received by the fixed network unit 5 exceeds a predetermined threshold indicating the presence of a mobile network unit very nearby, the owner of that mobile network unit 7 is using the sink unit 26. Furthermore, in this instance, the fixed network unit 5 may be arranged internal the soap dispenser 41 in a compact arrangement out of harms way.

Figure 6:
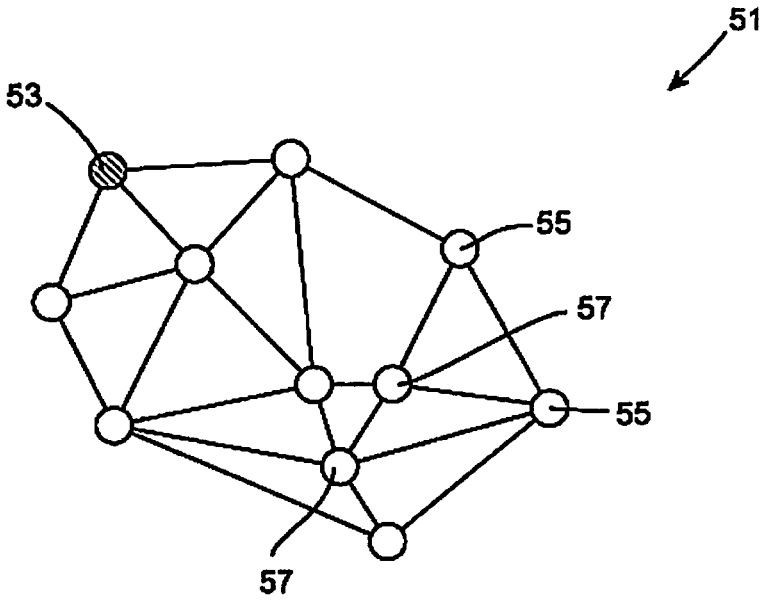
FIG. 6 is a diagrammatic representation of a ZigBee network that may be used in accordance with the present invention.

Referring to FIG. 6 of the drawings, there is shown a ZigBee network configuration, indicated generally by the reference numeral 51 that may be used in accordance with the invention. It is envisaged that a wireless personal area network (WPAN) is particularly suitable for use with the present invention and that the ZigBee architecture in particular is an extremely useful configuration to use due to the low amount of data that must be transferred between the network units and the low power, usage and signal strength that must be used. All of these will facilitate a system that requires low maintenance and that furthermore will not have a tendency to interfere with external medical monitoring equipment and the like. The ZigBee network comprises a gateway node 53 which communicates directly with the monitoring unit (not shown), in this case a management information system of the hospital, a plurality of static network nodes 55 and a plurality of mobile network nodes 57. The static network nodes 55 will typically comprise the room sensors that collate information from mobile nodes and transmit the data onwards to the monitoring unit via the gateway node 53. The mobile nodes on the other hand will typically comprise the staff identification cards, and the dispenser chips that transmit usage information relating to a particular user from the mobile network node to the monitoring unit via the fixed network nodes 55 and the gateway node 53.

It is envisaged that the monitoring unit 3 will be able to provide a statistical analysis of the movement of staff members throughout the monitored areas. If need be, the monitoring unit may generate various reports for management or for the health authority to allow them determine the effectiveness and also to determine the adherence to the clean hands policy. For example, the reports may determine that the staff in the maternity ward are washing their hands far more regularly than staff in the oncology department and on the strength of this information they may make the necessary changes to practice in the oncology department or alternatively, they may seek to determine is there a particular reason why there are less instances of hand washing in the oncology department. It may be the case that there are simply less staff or patients or that the contact instances are far lower in certain wards than others. Furthermore, the reports will allow the hospital or health authority, on a patient contracting the MRSA bug under their care to determine whether or not a member of their staff is potentially responsible through negligent acts and poor hygiene standards for the patient getting the infection. Furthermore, if accusations are made against a particular member of staff, checks of the reports may be made to determine the level of hygiene care taken by an individual particularly when handling that patient.

Finally, it is further envisaged that the system and method according to the invention could be carried out using a variety of disparate equipment other than the equipment described above. For example, the mobile network unit may be incorporated into a dispensing mechanism as shown or into another construction of dispensing mechanism. The mobile network units may be provided with a card reader or keypad or similar device to allow a number of users interchangeably use the same mobile network unit with their own individual identity card to identify them as the individual using a particular mobile network device. Alternatively, the mobile network unit may be independent of any dispensing device and may be incorporated into the clothing of an individual, i.e. in their surgical gown to monitor the user in that manner. Finally, other equipment may also be tagged with a mobile network unit using the system to keep track of the equipment as it moves through the hospital from ward to ward. This will allow tracking of the equipment as well as monitoring potential sources of infection from equipment.

It will be understood that the present system is aimed at providing a more accurate and comprehensive monitoring method and system that will enable the hospital management to monitor the hygiene practices of the staff, identify deficiencies in those practices, identify particular offenders or teams of offenders, identify potential problem areas, provide accountability and also a degree of certainty as to the origin of a particular infection and therefore to run a more comprehensively managed hospital that will be able to increase the levels of funding received duo to improved work practices and furthermore, reduce insurance premiums by providing a safer environment.

It will be further understood that throughout this specification, various references have been made to staff and employees when referring to the specific example of a system incorporated in a hospital. It will be understood that this terminology has been used for illustrative purposes only and that the staff or employee may in fact not be someone directly employed by the hospital such as a consultant of the like. The term staff and employee are deemed to incorporate nurses, doctors, surgeons, consultants, other individuals and even members of the public entering the medical facility that may be required to use the system. Furthermore, the term antibacterial has bean used throughout to describe cleaning agents but it will be understood that the term in fact encompasses all approved cleaning agents as specified by the hospital or health authorities that are deemed suitable to prevent the spread of the infectious diseases concerned.

Throughout this specification, the terms medical facility and hospital have been used throughout. It will however be understood that essentially any healthcare facility, whether it is a hospital, nursing home, day care centre, is intended to be covered under the scope of this application and it is not simply limited to hospitals. Furthermore, the term medical faculty, hospitals and patients are not limited to facilities for humans and it is envisaged that the same measures may be used throughout veterinary surgeries and other medical facilities for animals in fact, at present, MRSA in particular has been found to infect animals including horses and pigs and it is envisaged that the same level of accountability may be required in these environments as described for humans. Although the term MRSA has been used extensively throughout the specification, it is clear that the invention is not solely limited to a system for monitoring and controlling the spread of MRSA but is in fact suitable for monitoring and controlling the spread of similar types of infections in general, which may be broadly termed under the heading multi resistant acquired infection. Furthermore, the invention is in fact deemed suitable for monitoring and assisting in the control of the vast majority of infections that are transmitted and preventable in the manner described in the specification. It will be understood that although the invention has been described in terms of ZigBee, other different communication systems and other wireless and partially wired systems could equally well be used within the scope of the invention and this application is not limited solely to the use of ZigBee.

In this specification the terms "comprise, comprises, comprised and comprising" and the terms "include, includes, included and including" are all deemed totally interchangeable and should be afforded the widest possible interpretation.

The invention is in no way limited to the embodiments hereinbefore described but may be varied in both construction and detail within the scope of the claims.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A hygiene monitoring system for monitoring hygiene standards compliance in a facility, the hygiene monitoring system utilizing only radio frequency (RF) signals and comprising a surveillance network including a monitoring unit, a plurality of fixed network units, and a plurality of mobile network units;

each of said plurality of mobile network units including a transmitter for transmitting a first identification signal and a second identification signal, the first identification signal transmitted periodically and the first identification signal particular to a position of an individual associated with one of said plurality of mobile network units, the second identification signal transmitted sporadically and the second identification signal resultant from an action performed by the individual associated with the one of said plurality of mobile network units;

said surveillance network further comprising the plurality of fixed network units dispersed throughout the facility, each of said plurality of fixed network units including a transceiver to receive the first identification signal and the second identification signal from one or more of said plurality of mobile network units and transmit the first identification signal and the second identification signal to said monitoring unit;

said each of said plurality of mobile network units and said each of said plurality of fixed network units together forming a wireless personal area network (WPAN);

said monitoring unit further comprising a receiver for receiving the first identification signal and the second identification signal, an accessible memory for storing the first identification signal and the second identification signal, and a processor to analyse the first identification signal and the second identification signal in accessible memory and generate a hygiene standards compliance profile for the particular individual associated with said each of said plurality of mobile network units;

said each of said plurality of fixed network units further comprises a sensor to determine radio frequency signal strength data of each first identification signal received from said each of said plurality of mobile network units, for onward transmission of radio frequency signal strength data to said monitoring unit along with the corresponding first identification signal;

said processor includes means to determine the position of said each of said plurality of mobile network units from the radio frequency signal strength data of each mobile unit received from two or more said plurality of fixed network units; and said monitoring unit includes means to access a floor plan layout of the facility and illustrate on the floor plan layout a point representing the first identification signal over time of each of said plurality of mobile network units to obtain a plot of a plurality of points representing a movement pattern of each mobile network unit, the movement pattern of each mobile network unit included in the hygiene standards compliance profile.

2. The system as claimed in claim 1 in which said each of said plurality of mobile network units are included as a component of an antibacterial fluid dispenser.

3. The system as claimed in claim 2 in which said antibacterial fluid dispenser further comprises a sensor to detect actuation of said antibacterial fluid dispenser, and means to generate the second identification signal for transmission in response to the actions of the particular individual associated with said mobile network unit comprises means to generate the second identification signal on the sensor detecting said antibacterial fluid dispenser being actuated.

4. The system as claimed in claim 1 in which each of said plurality of fixed network units includes means to receive the first identification signal from each of said plurality of mobile network units within a predetermined radius of each of said plurality of fixed network units.

5. The system as claimed in claim 4 in which the predetermined radius is a 5 meter radius.

6. The system as claimed in claim 1 in which each of said plurality of mobile network units further comprises a receiver to receive an identity code of a user and the first identification signal and second identification signal transmitted by each of said plurality of mobile network units is generated using the identity code of the user.

7. The system as claimed in claim 6 in which said receiver further comprises a card reader including means to read information from a data storage element on an identity card.

8. The system as claimed in claim 6 in which said receiver further comprises a keypad having means to receive an identity code input of the user on said keypad.

9. The system as claimed in claim 1 in which said processor includes an analyser to analyse movement patterns of one of said each of said plurality of individual mobile network units and a group of said plurality of said mobile network units.

10. The system as claimed in claim 9 in which said monitoring unit includes an analyser to analyse the movement patterns of one or more of said each of said plurality of mobile network units in a particular area of the facility.

11. The system as claimed in claim 9 in which said monitoring unit includes an alarm generator to generate an alarm based on predetermined irregular usage patterns of one or more of said each of said plurality of mobile network units.

12. The system as claimed in claim 1 in which the monitoring unit includes a comparator to compare activity of one of said plurality of mobile network units in the facility with a predetermined set of mobile network unit parameters and an alarm generator to generate an alarm if the activity of said one of said plurality of mobile network units is outside the predetermined set of mobile network unit parameters.

13. The system as claimed in claim 1 in which said monitoring unit includes a reporter to generate a report based on the hygiene standards compliance profile of one or more said plurality of mobile network units over a given period of time.

14. The system as claimed in claim 13 in which said monitoring unit includes a transmitter to transmit the report to a remote station for further analysis of the report.

15. The system as claimed in claim 1 further comprising a plurality of identification network units, each of said plurality of identification network units is associated with a patient in the facility, the identification network units including a transmitter to transmit a patient identifier signal to said monitoring unit and said monitoring unit including means to illustrate a point representing a plot of the position of the patient in the medical facility over time.

16. A method utilizing only radio frequency (RF) signals for monitoring hygiene standards compliance by individuals in a facility, the facility having a surveillance network comprising a monitoring unit and a plurality of mobile network units, the mobile network units each having a transmitter for transmitting a first identification signal and a second identification signal, each particular to an individual associated with one of the plurality of mobile network units, the surveillance network further comprising a plurality of fixed network units dispersed throughout the facility, each of the plurality of fixed network units including a transceiver to receive the first identification signal and the second identification signal from the plurality of mobile network units and transmit the identification signal onward to the monitoring unit, the plurality of mobile network units and the plurality of fixed network units together forming part of a wireless personal area network (WPAN), the monitoring unit including a processor, an accessible memory, and a receiver for receiving the first identification signal and the second identification signal, the method comprising the steps of:

transmitting the first identification signal and the second identification signal by the one of the plurality of mobile network units to the monitoring unit via at least one of the plurality of fixed network units in the WPAN, the first identification signal transmitted periodically and the first identification signal particular to a position of an individual associated with one of said plurality of mobile network units, the second identification signal transmitted upon an action performed by the individual associated with the one of said plurality of mobile network units;

receiving the first identification signal and the second identification signal by the monitoring unit;

storing the first identification signal and the second identification signal in accessible memory;

analyzing the first identification signal and the second identification signal stored in accessible memory and thereafter generating a hygiene standards compliance profile for one or more of the individuals associated with the one or more of the plurality mobile network units, wherein the step of generating the hygiene standards compliance profile includes illustrating by the monitoring unit a point representing the location of the each of the plurality of mobile network units in the facility over time to obtain a plurality of points representing a plot of a movement pattern of each mobile network unit; and accepting the first identification signal by two or more of the plurality of fixed network units directly from the each of the plurality of mobile network unit and determining by each of the plurality of fixed network units radio frequency signal strength data of the first identification signal and providing the radio frequency signal strength data to the monitoring unit along with the first identification signal such that the monitoring unit can determine the position of the each of the plurality of mobile network units in the facility from the radio frequency signal strength data.

17. The method as claimed in claim 16 further comprising transferring the identification signal from the one of the plurality of mobile network units to the monitoring unit on actuation of an antibacterial fluid dispenser that includes the mobile network unit as a component thereof.

18. The method as claimed in claim 17 wherein said transferring step occurs when the one of the plurality of mobile network units comes at least within a predetermined distance of a hand washing facility.

19. The method as claimed in claim 18 further comprising sending the identification signal periodically from each of the plurality of mobile network units to the monitoring unit.

20. The method as claimed in claim 16 further comprising sending the identification signal periodically from each of the plurality of mobile network units to the monitoring unit.

21. The method as claimed in claim 20 further comprising communicating the identification signal from the each of the plurality of mobile network units to the monitoring unit in response to the actions of the particular individual associated with the each of the plurality of mobile network units.

22. The method as claimed in claim 16 further comprising conveying position data from each of the plurality of mobile network units to the monitoring unit along with the identification signal giving the position of the each of the plurality of mobile network units in the facility.

23. The method as claimed in claim 16 in which the step of generating a hygiene standards compliance profile for each of the mobile network unit users further comprises determining the number of times that the mobile network unit user washes his or her hands in a particular time period.

24. The method as claimed in claim 16 in which the method further comprises combining the hygiene standards compliance profile of a plurality of mobile network unit users and generating the hygiene standards compliance profiles for a group of users.

25. The method as claimed in claim 16 in which the method further comprises comparing by the monitoring unit of the activity of a mobile network unit user with a predetermined set of mobile network unit parameters and generating an alarm if the activity of the mobile network unit user is outside the predetermined set of mobile network unit parameters.

26. The method as claimed in claim 16 further comprising receiving an identity code of the user and generating by the mobile network unit the identification signal based on the identity code of the user.

27. The method as claimed in claim 16 further comprising analyzing by the processor the activity patterns of one or more of the plurality of mobile network units.

28. The method as claimed in claim 27 in which the analyzing step includes an analysis of the activity patterns of one or more of the plurality of mobile network units in a particular area.

29. The method as claimed in claim 27 further comprising producing by the processor of an alarm on detecting irregular activity patterns of one or more of the plurality of mobile network units.

30. The system as claimed in claim 1 in which the wireless personal area network (WPAN) is a ZigBee wireless personal area network.

31. The method as claimed in claim 17 wherein the wireless personal area network (WPAN) is a ZigBee wireless personal area network.

32. The method as claimed in claim 16, wherein the movement pattern of each mobile network unit is included in the hygiene standards compliance profile.

33. A method utilizing only radio frequency (RF) signals for monitoring hygiene standards compliance by individuals in a facility, the facility having a surveillance network comprising a monitoring unit and a plurality of mobile network units, the mobile network units each having a transmitter for transmitting a first identification signal and a second identification signal, each particular to an individual associated with one of the plurality of mobile network units, the surveillance network further comprising a plurality of fixed network units dispersed throughout the facility, each of the plurality of fixed network units including a transceiver to receive the first identification signal and the second identification signal from the plurality of mobile network units and transmit the identification signal onward to the monitoring unit, the plurality of mobile network units and the plurality of fixed network units together forming part of a wireless personal area network (WPAN), the monitoring unit including a processor, an accessible memory, and a receiver for receiving the first identification signal and the second identification signal, the method comprising the steps of:

transmitting the first identification signal and the second identification signal by the one of the plurality of mobile network units to the monitoring unit via at least one of the plurality of fixed network units in the WPAN, the first identification signal transmitted periodically and the first identification signal particular to a position of an individual associated with one of said plurality of mobile network units, the second identification signal transmitted upon an action performed by the individual associated with the one of said plurality of mobile network units;

receiving the first identification signal and the second identification signal by the monitoring unit;

storing the first identification signal and the second identification signal in accessible memory;

analyzing the first identification signal and the second identification signal stored in accessible memory and thereafter generating a hygiene standards compliance profile for one or more of the individuals associated with the one or more of the plurality mobile network units;

accepting the first identification signal by two or more of the plurality of fixed network units directly from the each of the plurality of mobile network unit and determining by each of the plurality of fixed network units radio frequency signal strength data of the first identification signal and providing the radio frequency signal strength data to the monitoring unit along with the first identification signal such that the monitoring unit can determine the position of the each of the plurality of mobile network units in the facility from the radio frequency signal strength data; and said monitoring unit further comprising a means to access a floor plan layout of the facility and illustrate on the floor plan layout a point representing the first identification signal over time of each of said plurality of mobile network units to obtain a plurality of points representing a plot of a movement pattern of each mobile network unit.

34. The method as claimed in claim 33, wherein the movement pattern of each mobile network unit is included in the hygiene standards compliance profile.

* * * * *